US009312626B2

(12) United States Patent
Itsuki et al.

(10) Patent No.: US 9,312,626 B2
(45) Date of Patent: Apr. 12, 2016

(54) SHIELD CONNECTOR

(71) Applicant: Sumitomo Wiring Systems, Ltd., Yokkaichi, Mie (JP)

(72) Inventors: Kiyotaka Itsuki, Yokkaichi (JP); Hiroyuki Matsuoka, Yokkaichi (JP); Tomokazu Kashiwada, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/050,480

(22) Filed: Oct. 10, 2013

(65) Prior Publication Data

US 2014/0120767 A1 May 1, 2014

(30) Foreign Application Priority Data

Oct. 25, 2012 (JP) ..... 2012-235746

(51) Int. Cl.

| | |
|---|---|
| ***H01R 13/52*** | (2006.01) |
| ***H01R 13/6581*** | (2011.01) |
| ***H01R 13/6593*** | (2011.01) |
| ***H01R 103/00*** | (2006.01) |

(52) U.S. Cl.

CPC ..... *H01R 13/5202* (2013.01); *H01R 13/5208* (2013.01); *H01R 13/6581* (2013.01); *H01R 13/6593* (2013.01); *H01R 2103/00* (2013.01)

(58) Field of Classification Search

CPC ..... H01R 13/5202; H01R 13/6581; H01R 13/648; H01R 13/6593; H01R 2103/00; H01R 13/187; H01R 13/6315; H01R 13/60

USPC ..... 439/578, 271, 152, 345, 564, 589, 573; 29/876; 123/99

See application file for complete search history.

(56) References Cited

U.S. PATENT DOCUMENTS

| | | | | |
|---|---|---|---|---|
| 7,544,068 | B2 * | 6/2009 | Glaab, III | H01R 13/512 439/607.01 |
| 2009/0137153 | A1 * | 5/2009 | Yoshioka et al. | 439/607.24 |
| 2012/0094537 | A1 * | 4/2012 | Aoki et al. | 439/620.26 |
| 2012/0100753 | A1 * | 4/2012 | Omae et al. | 439/588 |
| 2013/0065426 | A1 * | 3/2013 | Yamashita et al. | 439/449 |
| 2013/0316573 | A1 * | 11/2013 | Uno et al. | 439/573 |
| 2014/0004740 | A1 * | 1/2014 | Uno | H01R 13/6592 439/607.58 |
| 2014/0120763 | A1 * | 5/2014 | Itsuki | H01R 13/5825 439/382 |
| 2014/0287631 | A1 * | 9/2014 | Tashiro | H01R 13/521 439/733.1 |

* cited by examiner

*Primary Examiner* — Amy Cohen Johnson
*Assistant Examiner* — Oscar C Jimenez
(74) *Attorney, Agent, or Firm* — Gerald E. Hespos; Michael J. Porco; Matthew T. Hespos

(57) ABSTRACT

A shield connector (10) to be connected to a device-side connector (110) provided on a device includes female terminals (42) to be connected to device-side terminals (112) provided in the device-side connector (110), a housing main body (20) including a wire pull-out hole (25) from which outer wires (50) connected to the female terminals (42) are pulled out, a shield shell (60) to be connected to a shield case (100) of the device while covering the housing main body (20), and a resin molded body (80) held in close contact with the outer peripheral surfaces of the outer wires (50). The resin molded body (80) is vertically sandwiched by an opening edge portion (25A) of the wire pull-out hole (25) in the housing main body (20) and a shell-side holding portion (67) provided on the shield shell (60).

9 Claims, 11 Drawing Sheets

SHIELD CONNECTOR

BACKGROUND

1. Field of the Invention

The invention relates to a shield connector.

2. Description of the Related Art

U.S. Patent Application Publication No. 2012/0100753 discloses a shield connector with a wire-side terminal connected to an end of a wire. The wire-side terminal is accommodated in a housing that can be connected to a device-side connector in a device so that the wire-side terminal connects to a device-side terminal in the device-side connector. A shield shell covers the housing and has a lower opening. T the wire-side terminal is inserted through the lower opening of the shield shell and into the housing. A rubber plug seals the lower opening of the shield shell and is retained by a holder to prevent water from entering the shield shell.

Clearances are provided between the shield shell and the holder and between the holder and the wire to permit efficient assembly. Thus, the holder is assembled loosely with the wire and the shield shell. The loosely assembled holder will shake in a pull-out direction of the wire if the shield connector is used in an area subject to vibration, such as in a vehicle. This vibration is transmitted to the wire-side terminal and may cause trouble between the wire-side terminal and the device-side terminal.

The invention was completed based on the above situation and aims to avoid trouble between terminals due to vibration.

SUMMARY OF THE INVENTION

The invention is directed to a shield connector to be connected to a device-side connector provided on a device. The shield connector includes a housing and a terminal accommodated in the housing. The terminal is to be connected to a device-side terminal in the device-side connector. A wire is connected to the terminal and is pulled out of the housing. A shield shell covers the housing and is to be connected to a shield case of the device. A resin molded body is held in close contact with the outer peripheral surface of the wire and is sandwiched in a pull-out direction of the wire by a housing-side holding portion on the housing and a shell-side holding portion on the shield shell. This sandwiching of the resin molded body by the housing-side holding portion and the shell-side holding portion suppresses vibration of the wire in the pull-out direction caused by vibration of a vehicle or the like. The suppression of vibration of the wire in the housing prevents trouble between the terminal and the device-side terminal.

The housing may be formed with a wire pull-out hole from which the wire is pulled out from the interior of the housing and the housing-side holding portion may be an opening edge portion of the wire pull-out hole. Accordingly, the housing has a simple construction as compared with the case where the housing-side holding portion is provided separately on the inner side of the wire pull-out hole.

The resin molded body may fit into the wire pull-out hole. A housing-side seal ring may be mounted on the outer peripheral surface of the resin molded body for closely contacting the inner peripheral surface of the wire pull-out hole over the entire circumference. The housing-side seal ring provides sealing between the resin molded body and the inner peripheral surface of the wire pull-out hole and also functions as a shake suppressing portion for suppressing shaking of the resin molded body in the wire pull-out hole and for suppressing vibration of the wire in the pull-out direction due to the shaking of the resin molded body in the wire pull-out hole.

The shield shell may be formed to cover the resin molded body and the housing. A shell-side seal ring may be mounted on the outer peripheral surface of the resin molded body for closely contacting the outer peripheral surface of the resin molded body and the inner peripheral surface of the shield shell over the entire circumference. The shell-side seal ring provides sealing between the resin molded body and the shield shell and also functions as a shake suppressing portion for suppressing shaking of the resin molded body in the shield shell and suppressing vibration of the wire in the pull-out direction due to the shaking of the resin molded body in the shield shell.

The shield shell may be fixed to the shield case of the device by a bolt tightened in a direction intersecting with the pull-out direction of the wire. Thus, a fixing direction of the shield shell integral to the resin molded body intersects a vibration transmission direction for further suppressing vibration of the resin molded body.

DETAILED DESCRIPTION OF THE PREFERRED EMBODIMENTS

Figure 2:
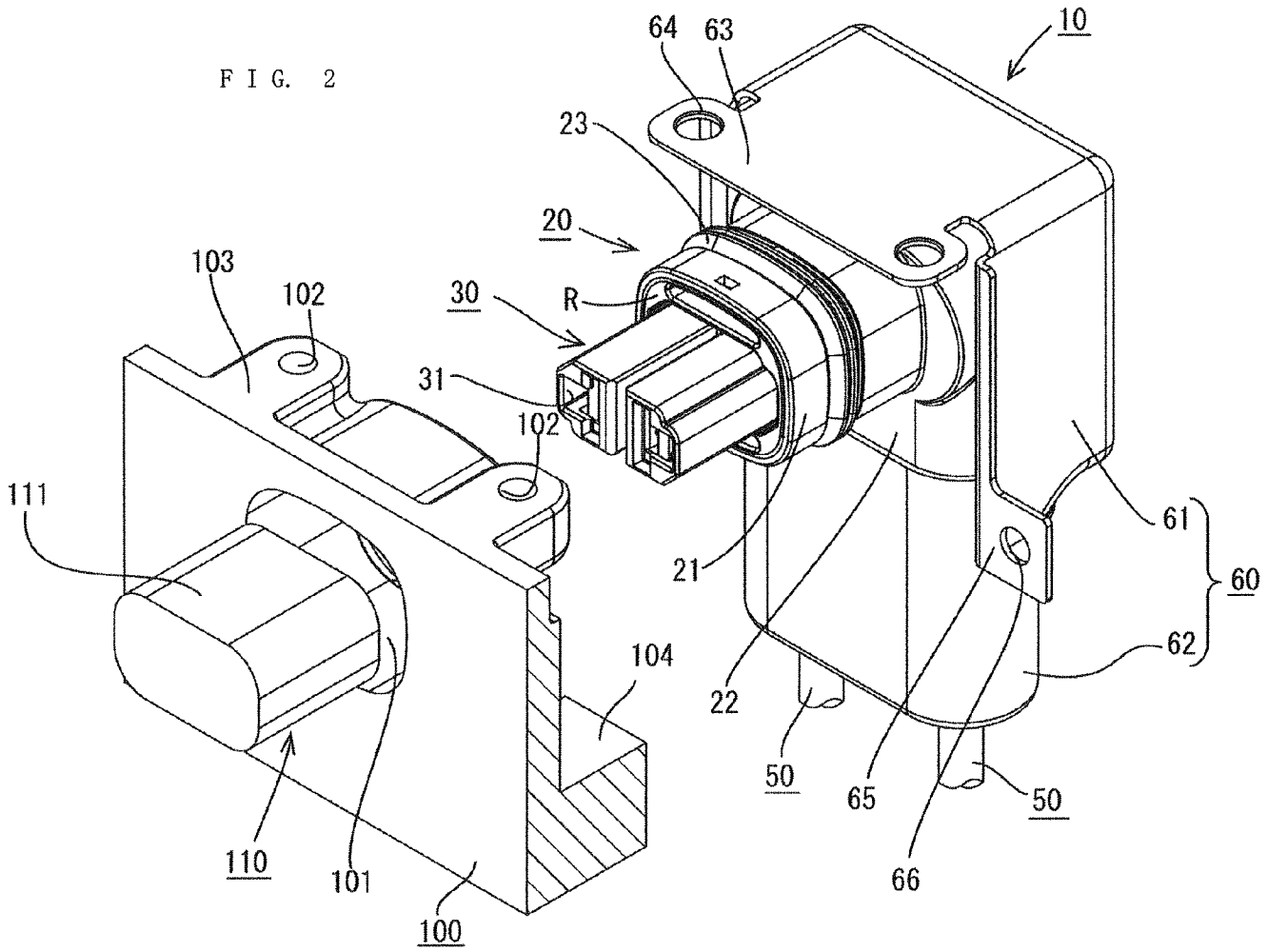
FIG. 2 is a perspective view showing a state before the shield connector is connected to a device-side connector when viewed from front.

A shield connector in accordance with an embodiment of the invention is identified by the numeral 10 in FIG. 2. The shield connector 10 is to be mounted on a shield case 100 of a device (e.g. inverter, motor or the like of a vehicle such as a hybrid vehicle or an electric vehicle). As shown in FIG. 2, a device-side connector 110 connectable to the shield connector 10 is arranged at a position facing the shield connector 10 in a connecting direction in the shield case 100. Note that, in the following description, a vertical direction is based on that of FIG. 5 and a lateral direction is based on that of FIG. 5. Further, forward and backward directions are based on lateral directions of FIG. 6, wherein a leftward direction (connecting direction to the device-side connector 110) is referred to as a forward direction and a rightward direction (separating direction from the device-side connector 110) is referred to as a backward direction.

The device is such that a device main body (not shown) is accommodated in the shield case 100 made of an electrically conductive material (left front side of the shield case 100 in FIG. 2 is an inner side of the shield case 100), and the shield case 100 includes a mounting hole 101 penetrating in inward and outward directions. Note that, for the device, only a part of the shield case 100 and the device-side connector 110 are shown and other parts are not shown.

Figure 3:
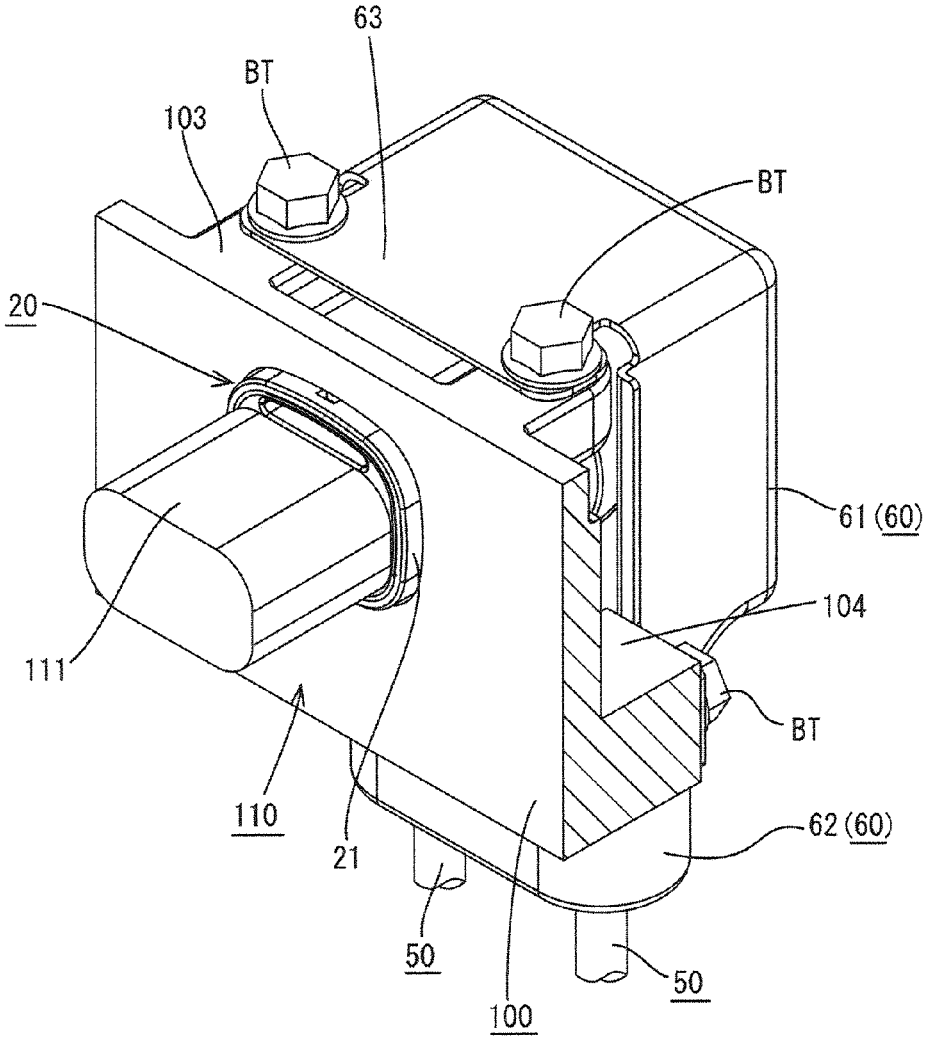
FIG. 3 is a perspective view showing a state after the shield connector is connected to the device-side connector when viewed from front.

Left and right fastening holes 102 are formed on the shield case 110 above the mounting hole 101 as shown in FIG. 2. The fastening holes 102 are formed on a horizontal surface 103 formed above the mounting hole 101 and open upward. Internal threads are formed on the inner peripheral surfaces of the fastening holes 102, and bolts BT can be screwed into these fastening holes 102 as shown in FIGS. 3 and 9.

Figure 8:
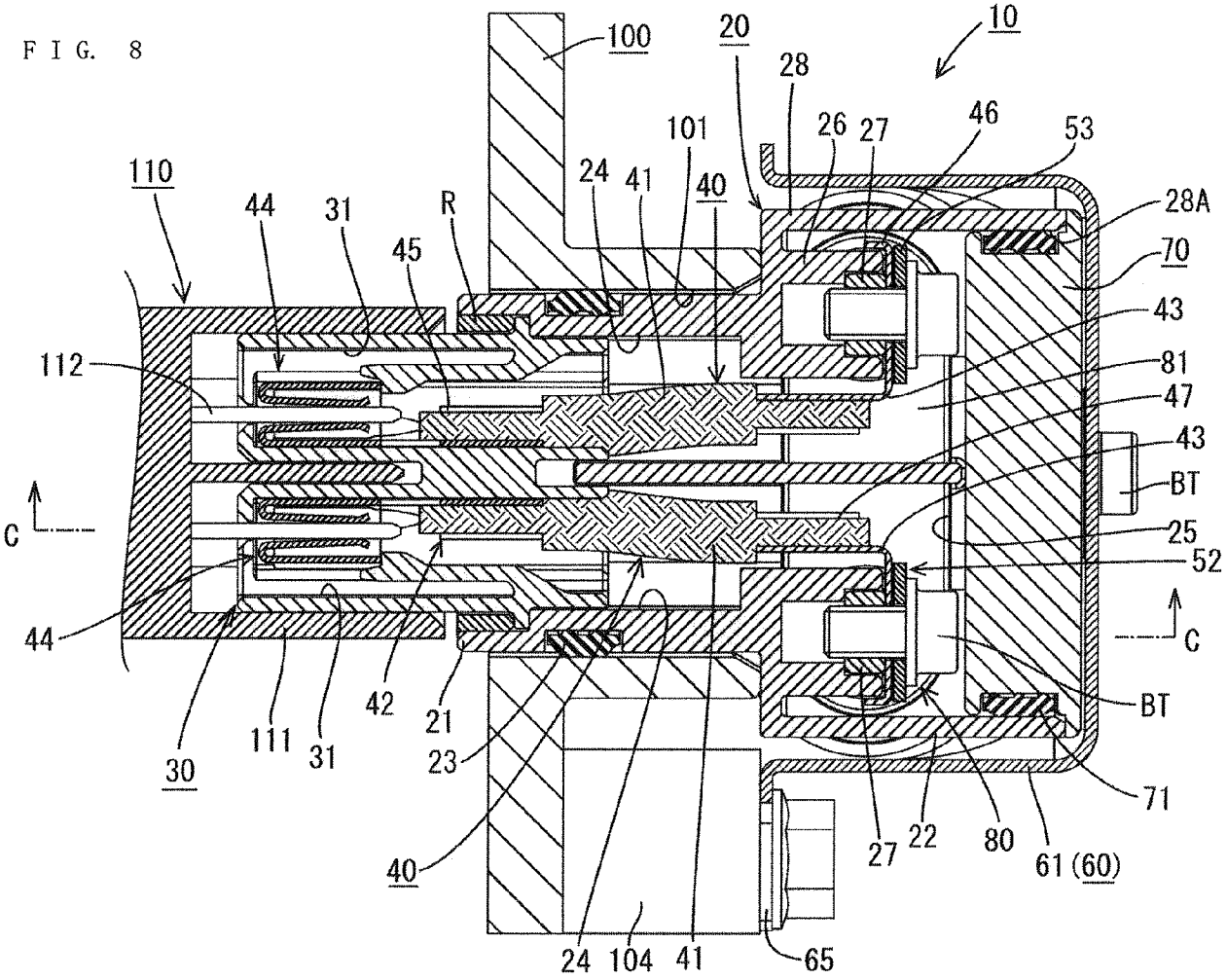
FIG. 8 is a section, corresponding to a cross-section along B-B of FIG. 6, showing the state after the shield connector is connected to the device-side connector.
Figure 9:
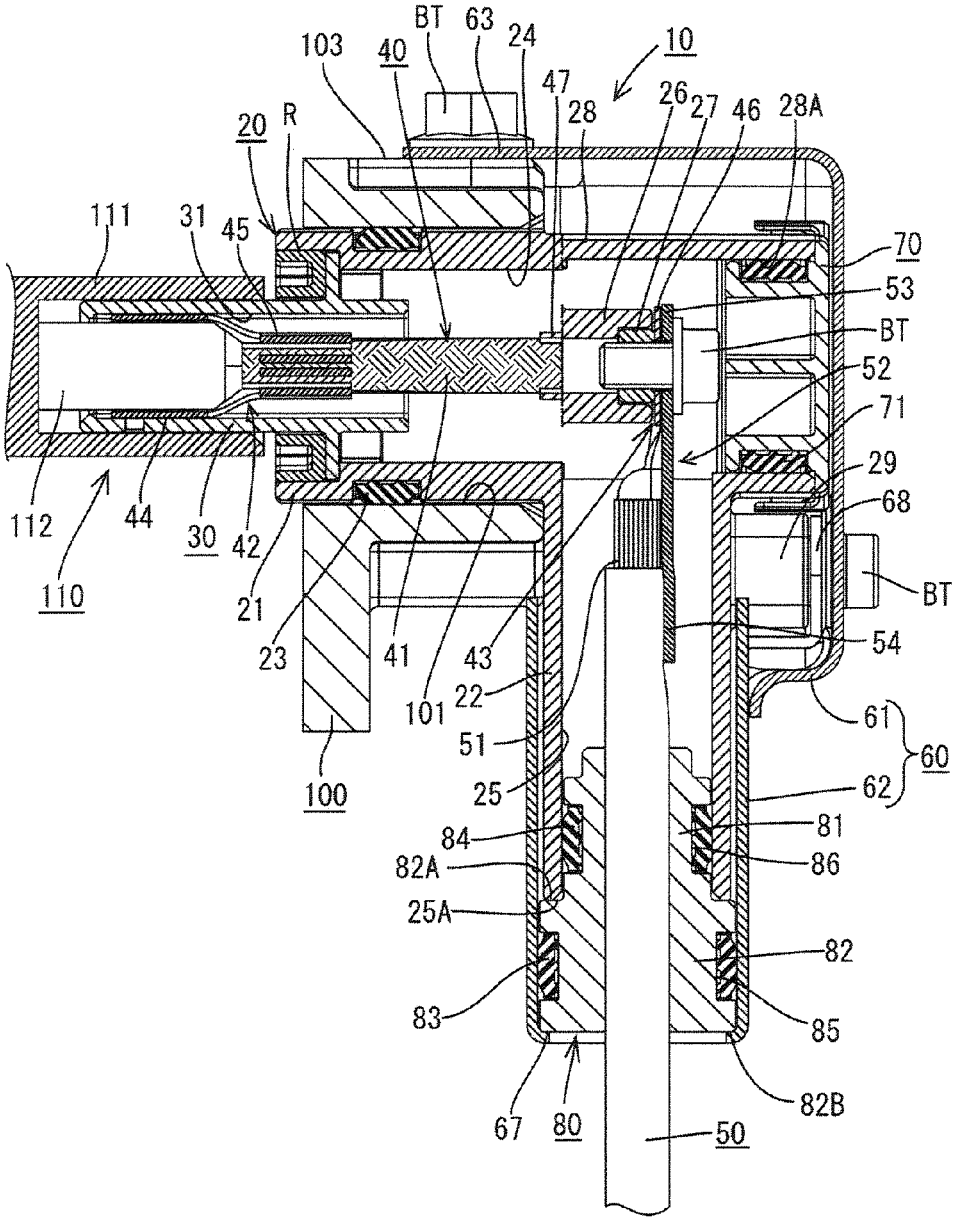
FIG. 9 is a section, corresponding to a cross-section along C-C of FIG. 8, showing the state after the shield connector is connected to the device-side connector.

As shown in FIGS. 8 and 9, the device-side connector 110 includes a receptacle 111 made of synthetic resin and tab-shaped device-side terminals 112 provided to project from the back wall of this receptacle 111.

Figure 1:
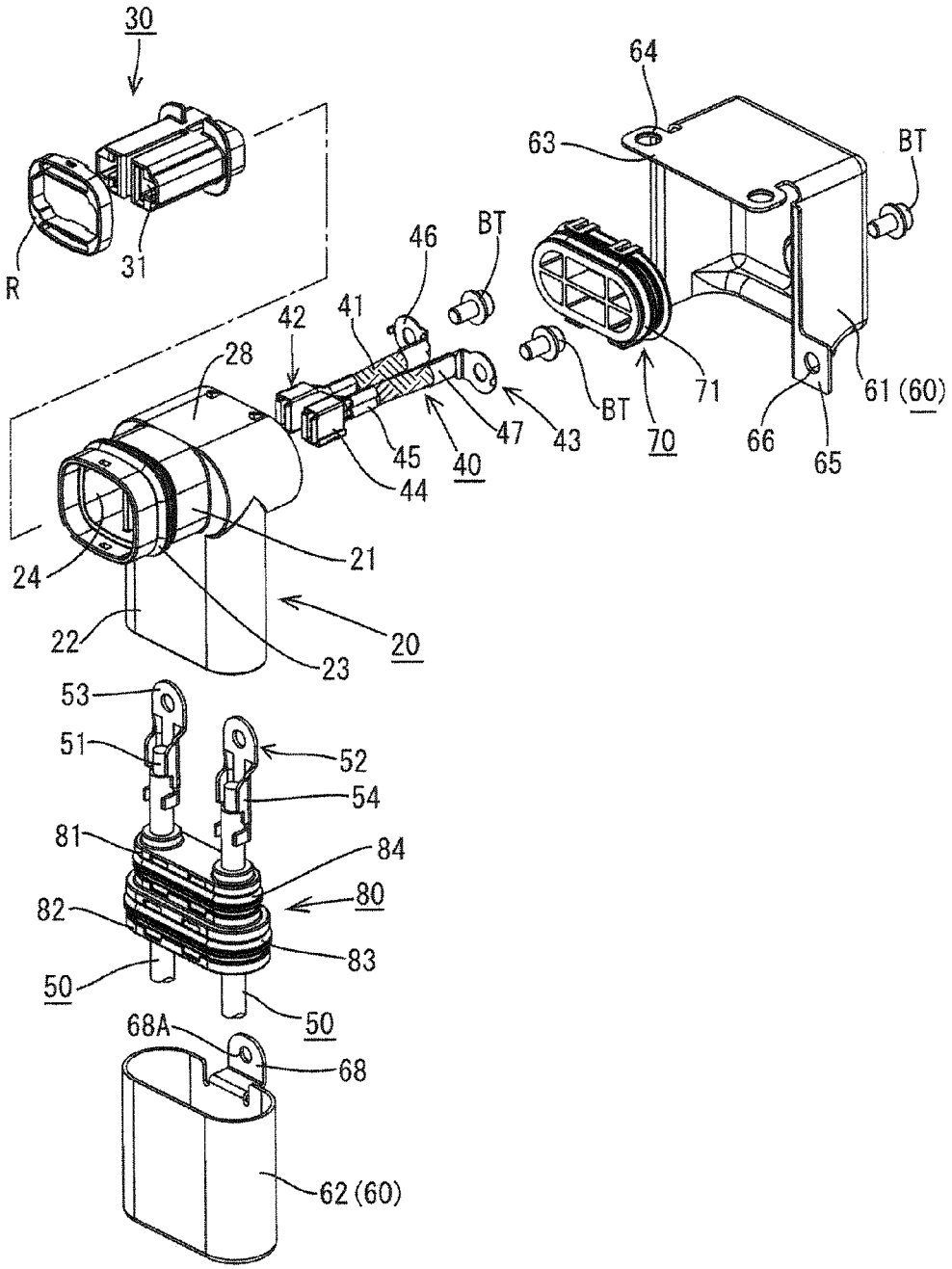
FIG. 1 is an exploded perspective view of a shield connector.

As shown in FIG. 1, the shield connector 10 includes a housing main body 20, a front housing 30, inner conductive members 40, outer wires 50, a shield shell 60 and the like. Note that an assembly of the housing main body 20 and the front housing 30 mentioned here corresponds to a housing.

The inner conductive member 40 includes an electrically conductive stretchable conductor 41 formed to be stretchable at least in an axial direction, a female terminal 42 connected to one end of the stretchable conductor 41 and an L-shaped intermediate terminal 43 connected to the other end of the stretchable conductor 41.

The stretchable conductor 41 is a flexible conductor and, for example, a braided wire formed by braiding metal thin wires made of copper or copper alloy into a mesh is used as such. Note that it is possible to use metal thin wires of aluminum or aluminum alloy or another flexible metal besides those of a and the like. Further, besides braided wires, various flexible conductive members such as wire conductors (twisted wires, etc.) and copper foils can be used.

The female terminal 42 includes a terminal connecting portion 44 in the form of a rectangular tube to be connected to the device-side terminal 112 of the device-side connector 100 and a barrel portion 45 connected behind this terminal connecting portion 44 and to be crimped to the stretchable conductor 41. On the other hand, the intermediate terminal 43 is formed such that a round connecting portion 46 into which the fixing screw BT is to be inserted and a barrel portion 47 connected to the round connecting portion 46 and to be crimped and connected to the stretchable conductor 41 are substantially at a right angle to each other. Note that although the stretchable conductor 41 is crimped to the female terminal 42 and the intermediate terminal 43 in this embodiment, there is no limitation to this and the stretchable conductor 41 may be connected to the female terminal 42 and the intermediate terminal 43 by various known connection means such as brazing and soldering and welding.

Figure 11:
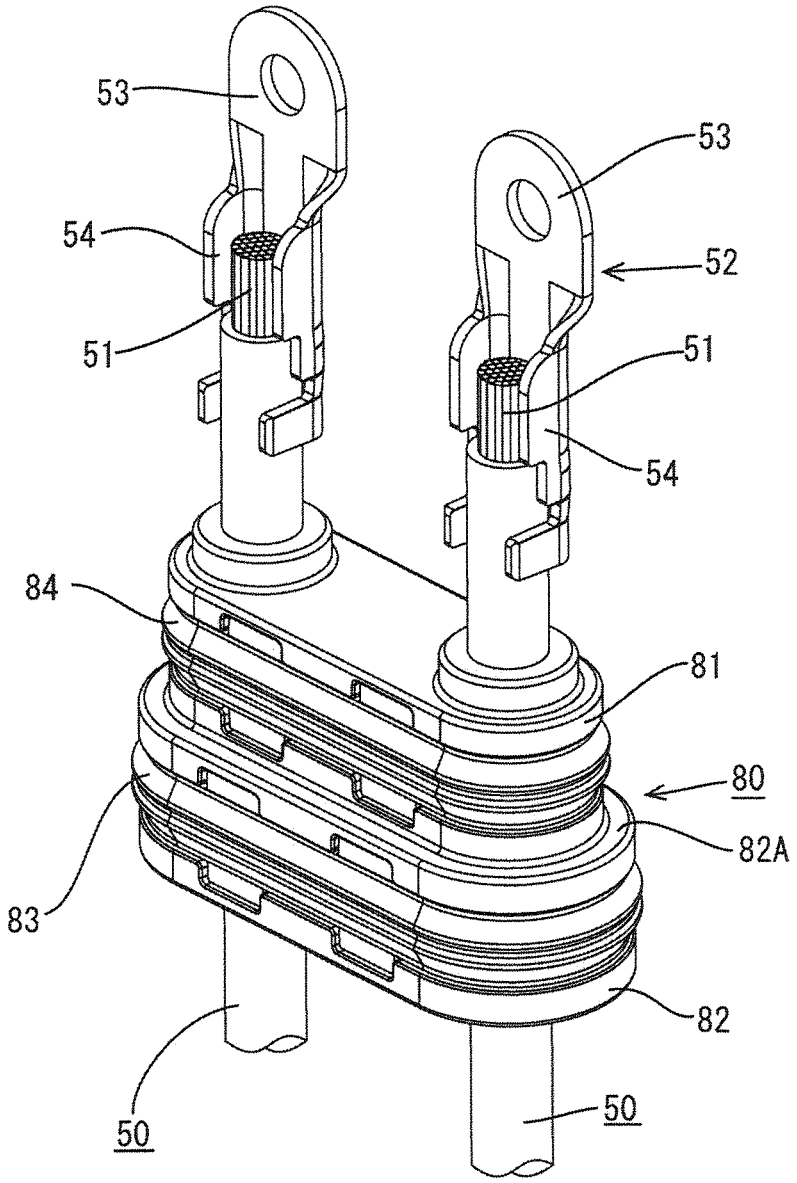
FIG. 11 is a perspective view showing a state where two wires are integrally fixed by a resin molded body.

As shown in FIG. 11, the outer wire 50 is a wire formed by covering a core 51 made of a plurality of metal strands with an insulation coating, and an LA terminal 52 is connected to the core 51 exposed at an end of this outer wire 50. The LA terminal 52 includes a round connecting portion 53 through which the fixing screw BT is to be inserted and a wire fixing portion 54 connected below the round connecting portion 53 and to be fixed to the core 51 of the outer wire 50. The wire fixing portion 54 is fixed to the core 51 by a known method such as soldering and brazing or welding. Note that the core 51 and the wire fixing portion 54 are connected not only by the above connection method, but may also be connected by various other known connection methods such as crimping.

Figure 7:
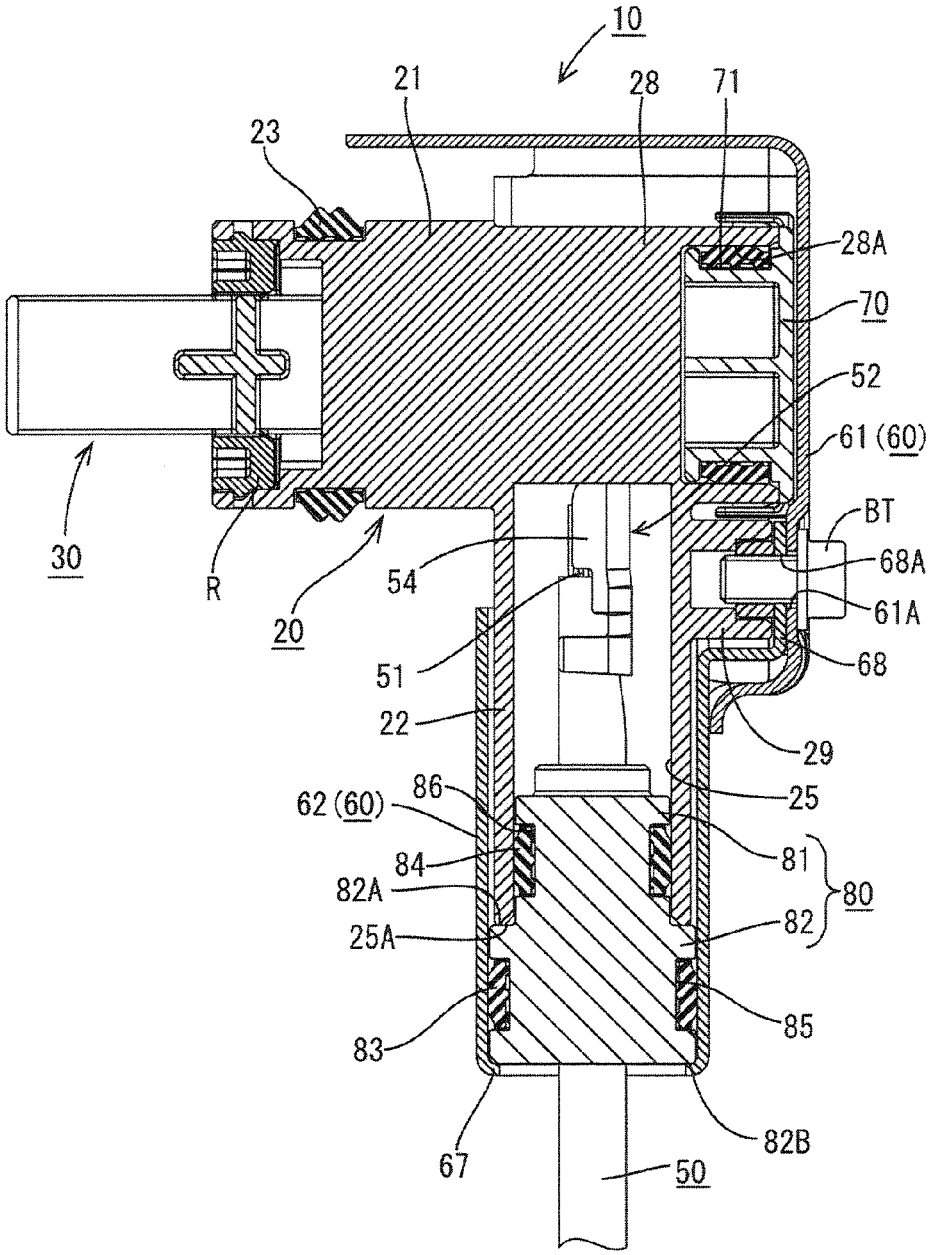
FIG. 7 is a section along A-A of FIG. 5.

The housing main body 20 is made of synthetic resin, substantially L-shaped when viewed sideways and configured such that a fitting portion 21 fittable into the mounting hole 101 of the shield case 100 and a wire pull-out portion 22 from which two outer wires 50 are pulled out downward are coupled by a coupling portion 28 as shown in FIGS. 7 and 9.

A seal ring 23 is fit externally on the outer peripheral surface of the fitting portion 21 and seals between the inner peripheral surface of the mounting hole 101 and the outer peripheral surface of the fitting portion 21 as shown in FIGS. 8 and 9 when the fitting portion 21 is fitted into the mounting hole 101 of the shield connector 100.

As shown in FIGS. 8 and 9, a rear half of the front housing 30 is fit into the fitting portion 21 from front and a front half thereof projects forward from the front surface of the fitting portion 21. Further, the front housing 30 is retained so as not to be detached forward by an annular front retainer R.

As shown in FIG. 8, the front housing 30 is provided with a pair of cavities 31 arranged side by side in the lateral direction. The female terminals 42 of the inner conductive members 40 are respectively held and retained in the cavities 31 and two stretchable conductors 41 are pulled out backward from a rear end part of the front housing 30.

Figure 10:
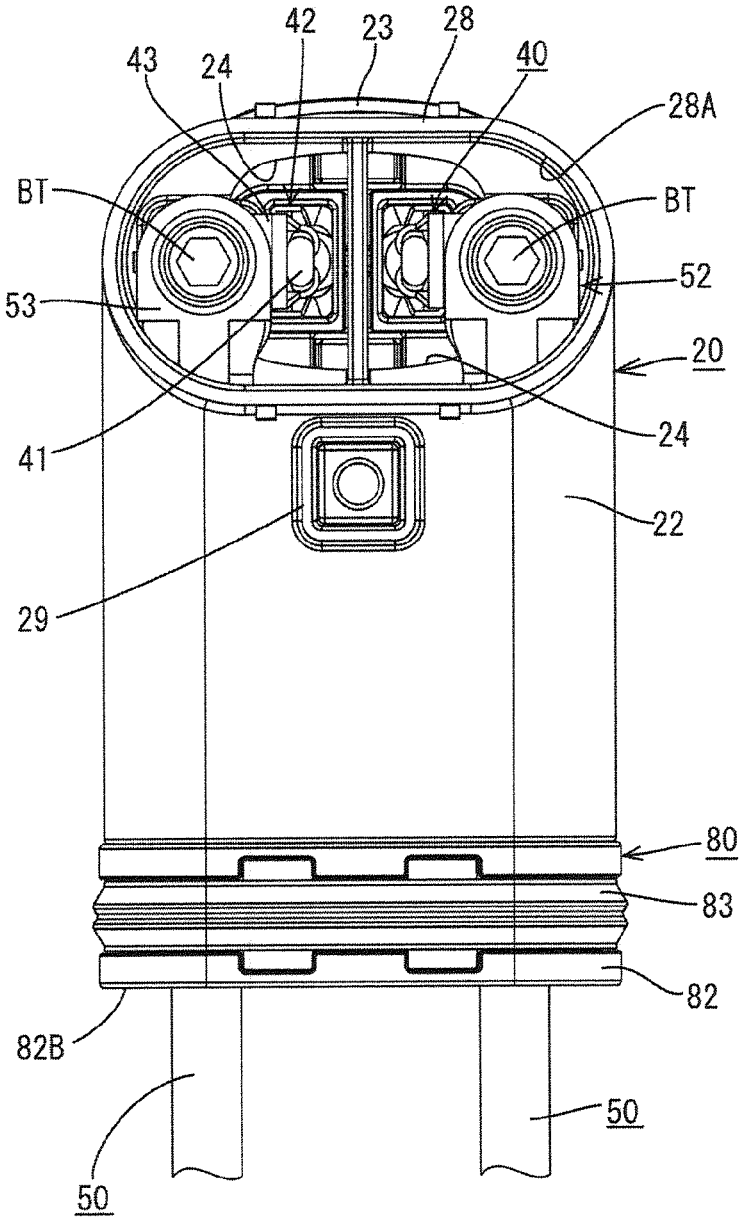
FIG. 10 is a rear view of the shield connector in a state where a shield shell and a cover are removed.

As shown in FIG. 8, left and right main-body side cavities 24 are formed in the fitting portion 21 and the coupling portion 28. The inner conductive members 40 are individually inserted into the main-body side cavities 24. On the other hand, the wire pull-out portion 22 is in the form of an elliptical cylinder long in the lateral direction as shown in FIGS. 1 and 10 and a wire pull-out hole 25 for collectively accommodating the two outer wires 50 is formed in the wire pull-out portion 22 as shown in FIGS. 7 to 9. This wire pull-out hole 25 is formed to have an elliptical cross-section and communicates with the pair of main-body side cavities 24 of the coupling portion 28. That is, an inner space of the housing main body 20 is laterally divided into two by the main-body side cavities 24 in the fitting portion 21 and the coupling portion 28 and is one unitary space in the wire pull-out portion 22.

As shown in FIGS. 8 and 9, terminal fitting portions 26 are provided in the coupling portion 28 of the housing main body 20. A fixing nut 27 is press-fit into each terminal fitting portion 26 from behind, the round connecting portion 46 of the intermediate terminal 43 and the round connecting portion 53 of the LA terminal 52 are arranged one next to the other on the rear surface of this fixing nut 27 and the bolt BT is inserted through the both round connecting portions 46, 53 and tightened into the fixing nut 27, whereby the intermediate terminal 43 and the LA terminal 52 are fixed and electrically connected to the terminal fitting portion 26.

As shown in FIGS. 8 to 10, an operation hole 28A to which the cover 70 is to be mounted is formed behind the terminal fixing portions 26 in the coupling portion 28. The operation hole 28A enables a tool for tightening the bolts BT into the terminal fitting portions 26 to be inserted from the outside.

The cover 70 includes a seal ring 71 which comes into close contact with the inner peripheral surface of the operation hole 28A to seal the interior of the housing main body 20, and gives protection so that water or the like does not enter the housing main body 20 through the operation hole 28A when the cover 70 is mounted to cover the operation hole 28A after the bolts BT are tightened.

Figure 6:
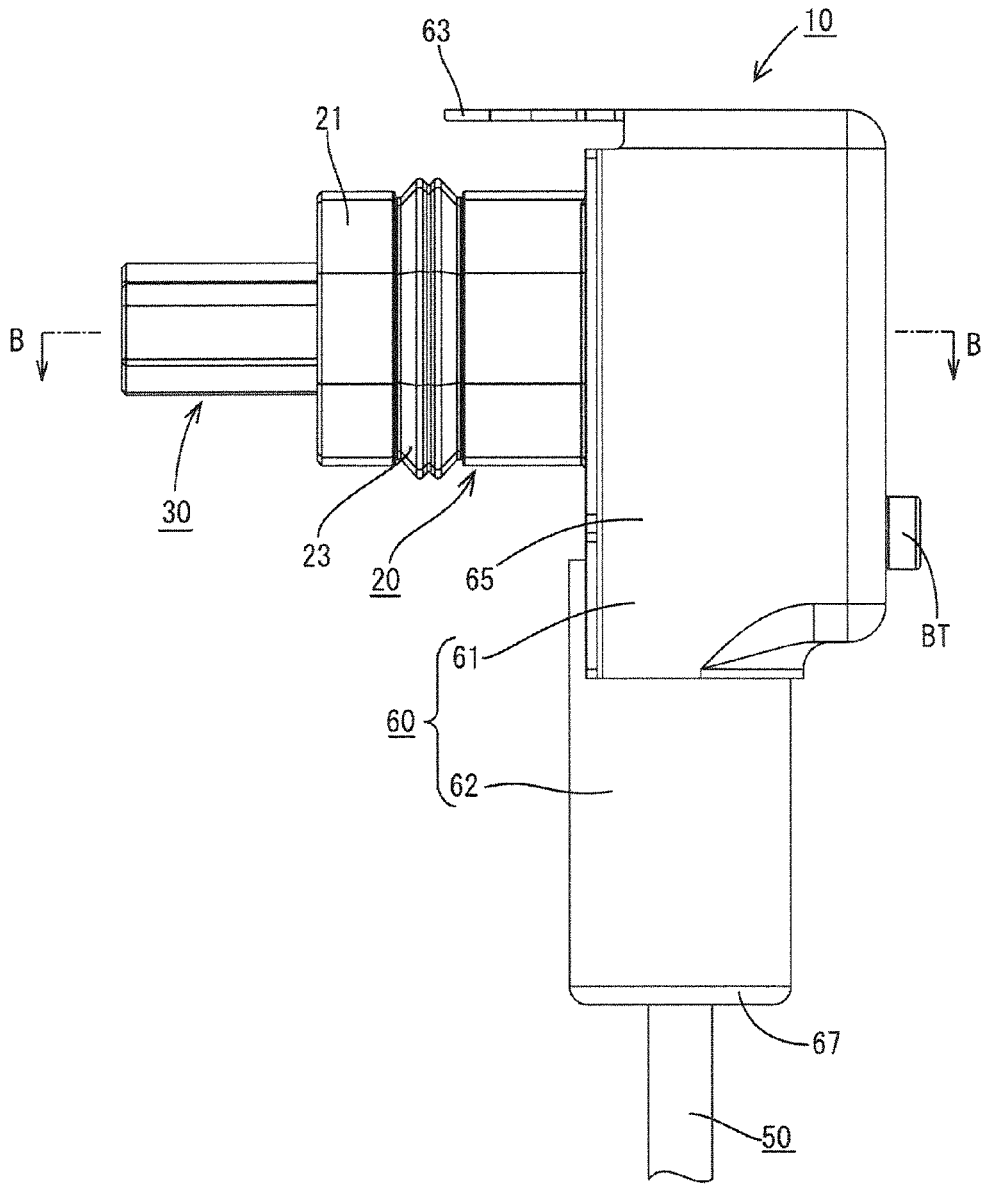
FIG. 6 is a side view of the shield connector.

This shield shell 60 is made of an electrically conductive metal plate material such as iron and formed by assembling an upper shell 61 and a lower shell 62 with each other as shown in FIGS. 6 and 7. Note that the shield shell may be formed using an electrically conductive metal plate material such as aluminum or aluminum alloy besides the iron metal plate material.

As shown in FIGS. 7 to 9, the upper shell 61 has a box shape to cover the coupling portion 28 of the housing main body 20 from behind. As shown in FIG. 2, a mounting piece 63 to be placed on the horizontal surface 103 of the shield case 100 projects forward from the upper front end edge of the upper shell 61. Through holes 64 corresponding to the fastening holes 102 of the horizontal surface 103 are formed to vertically penetrate through the mounting piece 63. By inserting the bolts BT through these through holes 64 and tightening them into the fastening holes 102, the mounting piece 63 is fixed to the shield case 100 and the shield shell 60 is electrically connected to the shield case 100 as shown in FIGS. 3 and 9.

Figure 4:
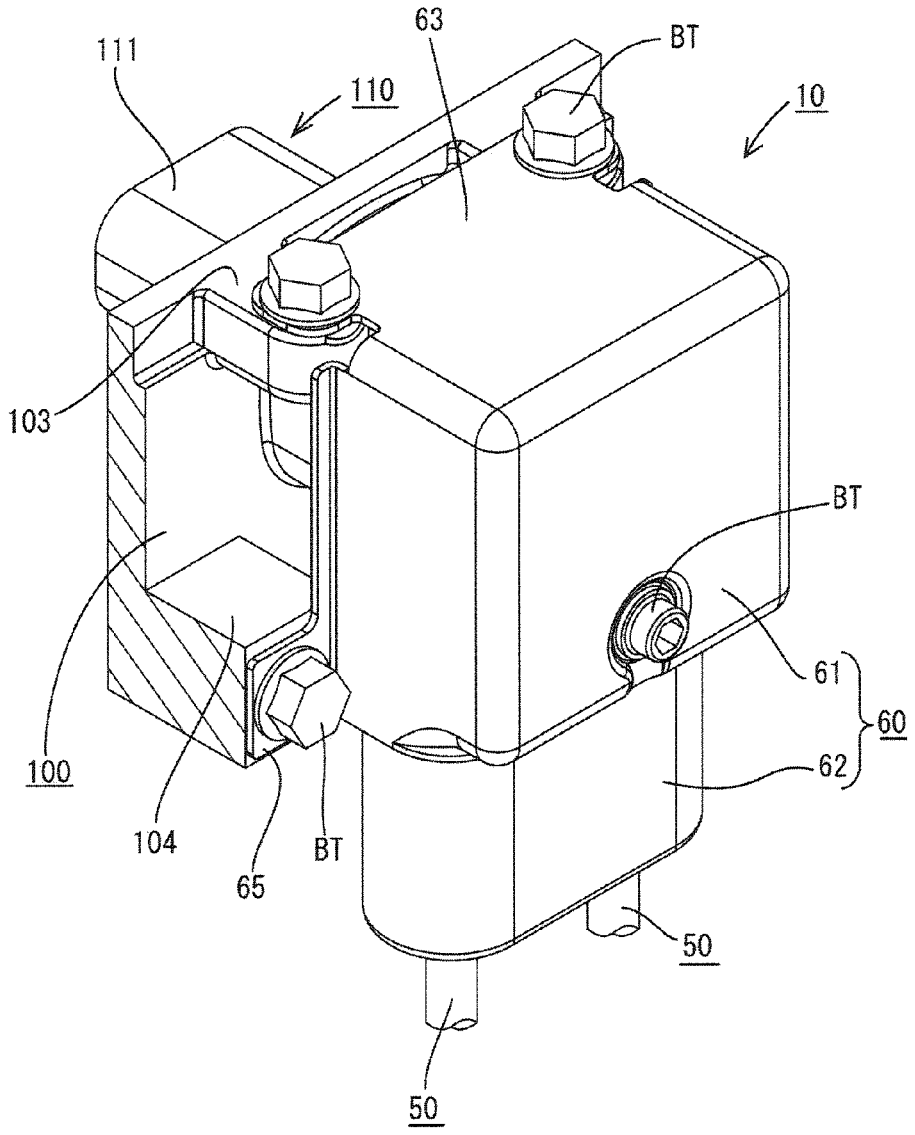
FIG. 4 is a perspective view showing the state after the shield connector is connected to the device-side connector when viewed from behind.
Figure 5:
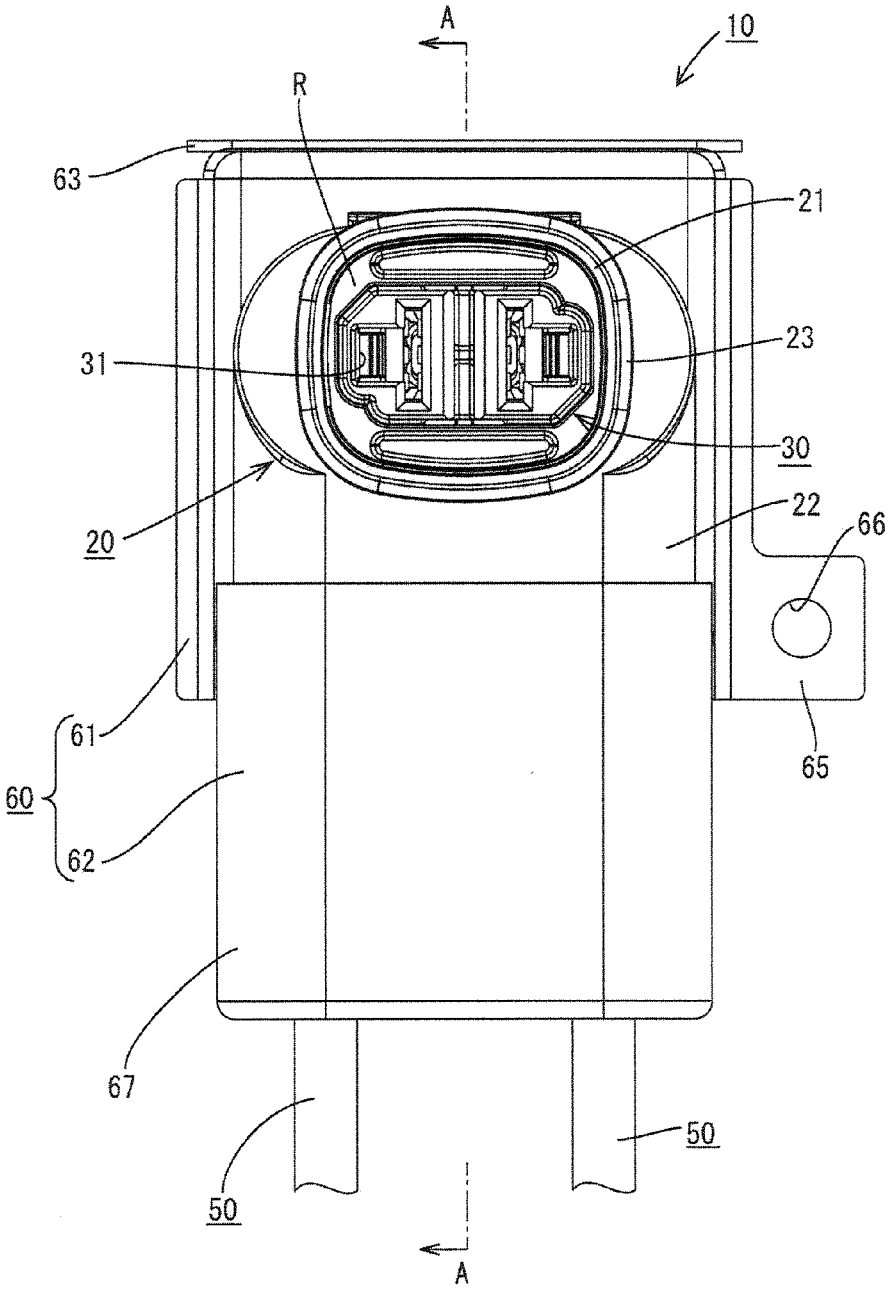
FIG. 5 is a front view of the shield connector.

An auxiliary mounting piece 65 projecting rightward is provided on a right lower end part of the upper shell 61 as shown in FIG. 5. This auxiliary mounting piece 65 can be placed on a mounting seat 104 provided lateral to (shown lower side in FIG. 8) the mounting hole 101 of the shield case 100 from behind, and is fixed to the mounting seat 104 by inserting the bolt BT through an insertion hole 66 penetrating through the auxiliary mounting piece 65 in forward and backward directions and tightening it into the mounting seat 104 in forward and backward directions (see FIGS. 4 and 8). Note that the auxiliary mounting piece 65 is electrically connected to the shield case 100 similarly to the mounting piece 63 when being fixed to the mounting seat 104.

That is, the upper shell 61 is fixed to the shield case 100 in the vertical direction at an upper end part and fixed to the shield case 100 in forward and backward directions at a lower end part, thereby being fixed to the shield case 100 without being unstable in either direction.

As shown in FIGS. 1 and 7, the lower shell 62 is in the form of an elliptical cylinder covering the outer peripheral surface of the wire pull-out portion 22, which is located in a lower half of the housing main body 20, over the entire circumference, and vertically open. Further, the lower shell 62 is mounted after the wire pull-out portion 22 is fitted thereinto. The shield shell 60 is formed by mounting the upper shell 61 on the housing main body 20 after the lower shell 62 is mounted on the housing main body 20. Further, when being mounted at a proper position with respect to the housing main body 20, the lower shell 62 is mounted in a state projecting downward from an opening edge portion 25A (an example of a "housing-side holding portion") of the wire pull-out hole 25 which is a lower end part of the wire pull-out portion 22.

Further, an unillustrated braided wire is connected to the outer peripheral surface of the lower shell 62 and a protective member (not shown) such as a corrugated tube is mounted on the outer periphery of the lower shell 62, whereby the outer wires 50 pulled out downwardly from the wire pull-out hole 25 are collectively shielded and protected by the protective member.

As shown in FIGS. 1 and 7, a coupling piece 68 including a bolt insertion hole 68A is formed substantially in a lateral central part of an upper end part of the rear surface of the lower shell 62. When the lower shell 62 is mounted on the housing main body 20, this coupling piece 68 is arranged to correspond to the shell fixing portion 29 provided on the rear surface of the housing main body 20. Further, when the upper shell 61 is mounted on the housing main body 20, a bolt insertion hole 61A formed in the lower end part of the upper shell 61 is placed behind and in correspondence with the coupling piece 68. By inserting and tightening the bolt BT through the both bolt insertion holes 61A, 68A, the upper shell 61 and the lower shell 62 are fixed to the housing main body 20 in an electrically connected state.

The resin molded body 80 is made of synthetic resin and is provided on the outer wires 50 pulled out down from the wire pull-out hole 25 of the wire pull-out portion 22 as shown in FIGS. 9 and 11. More particularly, the resin molded body 80 is molded onto the plurality of outer wires 50 pulled out from the wire pull-out hole 25 to define a uniform matrix of resin held in close contact with the outer peripheral surfaces of the outer wires 50. Further, the resin molded body 80 has an elliptical outer shape long in the lateral direction, an upper half of the resin molded body 80 serves as a molded fitting portion 81 that fits into the wire pull-out hole 25, and a lower half thereof serves as a molded main body 82 formed slightly larger than the molded fitting portion 81 by radially projecting over the entire circumference. Thus, a step is formed between the molded fitting portion 81 and the molded main body 82 as shown in FIGS. 7 and 9, and an upper end surface 82A of the molded main body 82 is a surface substantially perpendicular to an extending direction of the outer wires 50.

As shown in FIGS. 9 to 11, the molded main body 82 has substantially the same outer shape as that of the wire pull-out portion 22, and a height dimension in the vertical direction is slightly shorter than a downward projecting distance of the lower shell 62 from the position of the opening edge portion 25A of the wire pull-out hole 25. Further, a lower end surface 82B of the molded main body 82 is a surface formed to be parallel to the upper end surface 82A of the molded main body 82.

On the other hand, a shell-side holding portion 67 protruding inwardly over the entire circumference is formed on a lower opening edge portion of the lower shell 62. Thus, when the molded fitting portion 81 is fitted into the wire pull-out hole 25 and the lower shell 62 is mounted on the housing main body 20, the outer peripheral edge of the upper end surface 82A of the molded main body 82 is held in contact with the opening edge portion 25A of the wire pull-out hole 25 over the entire circumference and the outer peripheral edge of the lower end surface 82B of the molded main body 82 is held in contact with the shell-side holding portion 67 of the lower shell 62 over the entire circumference.

Specifically, when the resin molded body 80 is mounted into the wire pull-out portion 22 and the lower shell 62 is mounted on the housing main body 20, the molded main body 82 projecting radially outward of the molded fitting portion 81 over the entire circumference is vertically sandwiched by the opening edge portion 25A of the wire pull-out hole 25 and the shell-side holding portion 67 of the lower shell 62 as shown in FIGS. 7 and 9, wherein the shaking of the resin molded body 80 in the vertical direction is suppressed. Specifically, it is possible to suppress the vibration of the outer wires 50 in the vertical direction (pull-out direction of the outer wires 50) in the housing main body 20 due to the vibration of the vehicle. This can suppress the transmission of the vibration to the female terminals 42 and prevent the occurrence of a trouble between the female terminals 42 and the device-side terminals 112.

Further, since the opening edge portion 25A of the wire pull-out hole 25 is in contact with the upper end surface 82A of the molded main body 82, the complication of the structure of the housing main body 20 can be prevented as compared with the case where a housing-side holding portion is separately provided on the inner side of the wire pull-out hole.

Further, as shown in FIGS. 9 to 11, a shell-side seal ring mounting groove 85 into which an annular shell-side seal ring 83 is to be mounted is formed on the outer peripheral surface of the molded main body 82. This shell-side seal ring mounting groove 85 is formed by recessing the outer peripheral surface of the molded main body 82.

The shell-side seal ring 83 radially projects from the shell-side seal ring mounting groove 85 over the entire circumference. When the lower shell 62 is mounted on the housing main body 20, the shell-side seal ring 83 is held in close contact with the inner peripheral surface of the lower shell 62 and the shell-side seal ring mounting groove 85. That is, sealing is provided between the lower shell 62 and the molded main body 82 by the shell-side seal ring 83, thereby being able to prevent water entering through the upper opening of the lower shell 62 from entering the protective member (not shown) mounted on the outer peripheral surface of the lower shell 62 and suppress the shaking of the molded main body 82 in the lower shell 62. Specifically, the shell-side seal ring 83 for sealing between the lower shell 62 and the molded main body 82 can be caused to function as a shake suppressing portion for suppressing the shaking of the resin molded body 80 in the lower shell 62. This can further suppress the vibration of the outer wires 50 in the housing main body 20 due to the shaking of the resin molded body 80 in the lower shell 62.

On the other hand, a housing-side seal ring mounting groove 86 into which an annular housing-side seal ring 84 is to be mounted is formed on the outer peripheral surface of the molded fitting portion 81 as shown in FIGS. 9 and 11. This housing-side seal ring mounting groove 86 is formed by recessing the outer peripheral surface of the molded fitting portion 81.

The housing-side seal ring 84 radially projects from the housing-side seal ring mounting groove 86 over the entire circumference. When the molded fitting portion 81 is fitted into the wire pull-out hole 25, the housing-side seal ring 84 is held in close contact with the inner peripheral surface of the wire pull-out hole 25 and the housing-side seal ring mounting groove 86. That is, sealing is provided between the inner peripheral surface of the wire pull-out hole 25 and the molded fitting portion 81 by the housing-side seal ring 84, thereby being able to prevent water from entering the wire pull-out hole 25 and suppress the shaking of the molded fitting portion 81 in the wire pull-out hole 25. Specifically, the housing-side seal ring 84 for sealing between the molded fitting portion 81 and the inner peripheral surface of the wire pull-out hole 25 can be caused to function as a shake suppressing portion for suppressing the shaking of the resin molded body 80 in the wire pull-out hole 25. This can further suppress the vibration of the outer wires 50 in the housing main body 20 due to the shaking of the resin molded body 80 in the wire pull-out hole 25.

The shield connector 10 of this embodiment is configured as described above. Next, an example of a method for manufacturing the shield connector 10 is briefly described and then functions and effects of the shield connector 10 are described.

First, two outer wires 50 are inserted through the lower shell 62, and the LA terminal 52 is crimped to each outer wire 50. Subsequently, the two outer wires 50 are collectively molded, thereby forming the resin molded body 80 as shown in FIG. 11. Further, as shown in FIG. 1, the female terminal 42 is crimped to one end side of each stretchable conductor 41 and the intermediate terminal 43 is crimped to the other end side, thereby forming the inner conductive member 40.

Subsequently, the female terminals 42 are inserted into the cavities 31 of the front housing 30 mounted into the housing main body 20 from behind. When being inserted to proper positions of the cavities 31, the female terminals 42 are held and retained in the front housing 30. Further, the round connecting portions 46 of the intermediate terminals 43 are placed on the rear surfaces of the terminal fixing portions 26 of the housing main body 20.

Subsequently, the molded fitting portion 81 of the resin molded body 80 is inserted into the wire pull-out hole 25 of the wire pull-out portion 22 and fitted until the upper end surface 82A of the molded main body 82 comes into contact with the opening edge portion 25A of the wire pull-out hole 25. Further, when the molded fitting portion 81 is fitted into the wire pull-out hole 25, the housing-side seal ring 84 is held is close contact with the inner peripheral surface of the wire pull-out hole 25 and the housing-side seal ring mounting groove 86, thereby preventing water from entering the wire pull-out portion 22 and suppressing the shaking of the molded fitting portion 81 in the wire pull-out hole 25.

Subsequently, the round connecting portions 53 of the LA terminals 52 are placed on the rear surfaces of the round connecting portions 46 of the intermediate terminals 43 placed on the terminal fixing portions 26 of the coupling portion 28, and the bolts BT inserted through the operation hole 28A are inserted through the respective round connecting portions 46, 53 of the intermediate terminals 43 and the LA terminals 52 and tightened into the fixing nuts 27 of the terminal fixing portions 26 by the tool inserted through the operation hole 28A. In this way, as shown in FIGS. 8 and 9, the intermediate terminals 43 and the LA terminals 52 are fixed to the housing main body 20. Thereafter, by mounting the cover 70 to close the operation hole 28A, sealing is provided between the inner peripheral surface of the operation hole 28A and the cover 70 by the seal ring 71.

Subsequently, the lower shell 62 having the outer wires 50 inserted therethrough in advance is fitted and mounted onto the wire pull-out portion 22 and the resin molded body 80 from below. Then, the shell-side seal ring 83 is held in close contact with the inner peripheral surface of the lower shell 62 and the shell-side mounting groove 85. This prevents water having entered through the upper opening of the lower shell 62 from entering the protective member (not shown) mounted on the outer peripheral surface of the lower shell 62 and suppresses the shaking of the molded fitting portion 81 in the lower shell 62. Further, at this time, the shell-side holding portion 67 of the lower shell 62 comes into contact with the lower end surface 82B of the molded main body 82 of the resin molded body 80 and the molded main body 82 is vertically sandwiched by the opening edge portion 25A of the wire pull-out hole 25 and the shell-side holding portion 67 of the lower shell 62. In this way, the shaking of the resin molded body 80 in the vertical direction (pull-out direction of the outer wires 50) is restricted.

Finally, the bolt BT is inserted through the both bolt insertion holes 61A, 68A of the upper shell 61 and the lower shell 62 and the upper shell 62 and the lower shell 62 are fastened together by the bolt BT, whereby the shield shell 60 in which the upper shell 61 and the lower shell 62 are assembled and united is formed and the housing main body 20 is covered by this shield shell 60.

As described above, according to this embodiment, the resin molded body 80 collectively molding the outer wires 50 is vertically sandwiched by the opening edge portion 25A of the wire pull-out hole 25 and the shell-side holding portion 67 of the lower shell 62 as shown in FIGS. 7 and 9. Thus, the shaking of the resin molded body 80 in the vertical direction (pull-out direction of the outer wires 50) can be restricted. Specifically, it is possible to suppress the vibration of the outer wires 50 in the housing main body 20 due to the vibration of the vehicle or the like and prevent the occurrence of a trouble between the female terminals 42 and the device-side terminals 112.

Further, according to this embodiment, the housing seal ring 84 for sealing between the resin molded body 80 and the inner peripheral surface of the wire pull-out hole 25 doubles as the shake suppressing portion for suppressing the shaking of the resin molded body 80 in the wire pull-out hole 25 and the shell-side seal ring 83 for sealing between the resin molded body 80 and the lower shell 62 doubles as the shake suppressing portion for suppressing the shaking of the resin molded body 80 in the lower shell 62. Thus, the shaking of the resin molded body 80 in the wire pull-out hole 25 and the lower shell 62 can be suppressed without increasing the number of components. Consequently, the vibration of the outer wires 50 in the housing main body 20 can be further suppressed.

Further, according to this embodiment, even if all vibrations cannot be suppressed at the position of the resin molded body 80, the vibrations are blocked by the terminal fixing portions 26 and absorbed by the stretchable conductors 41 since the LA terminals 52 are fixed to the terminal fixing portions 26 and the inner conductive members 40 include the stretchable conductors 41, wherefore the occurrence of a trouble between the female terminals 42 and the device-side terminals 112 can be reliably prevented.

Furthermore, since a fixing direction (forward and backward directions) in which the auxiliary mounting piece 65 of the upper shell 61 integrally fixed to the housing main body 20 is fixed to the shield connector 100 is substantially perpendicular to a direction (vertical direction) in which the vibration is transmitted in the outer wires 50, the vibration can be further suppressed at the position where the auxiliary mounting piece 65 of the upper shell 61 is fixed to the shield connector 100.

The present invention is not limited to the above described and illustrated embodiment. For example, the following embodiments are also included in the technical scope of the present invention.

Although the shield connector 10 including the stretchable conductors 41 is illustrated in the above embodiment, the present invention is not limited to such a mode and can be, for example, applied to a shield connector including no stretchable conductor.

Although the two outer wires 50 are molded by the resin molded body 80 in the above embodiment, the present invention is not limited to such a mode. For example, the resin molded body may be formed by molding one, three or more outer wires.

Although the auxiliary mounting piece 65 is formed only on the right side of the upper shell 61 in the above embodiment, the present invention is not limited to such a mode. For example, auxiliary mounting pieces may be formed on both left and right sides of the upper shell.

Although the auxiliary mounting piece 65 is provided on the upper shell 61 in the above embodiment, the present invention is not limited to such a mode. For example, the auxiliary mounting piece may be formed on the lower shell.

Although the opening edge portion 25A of the wire pull-out hole 25 is brought into contact with the upper surface of the molded main body 82 in the above embodiment, the present invention is not limited to such a mode. For example, a housing holding portion capable of coming into contact with the upper surface of the resin molded body may be formed on the inner side of the wire pull-out hole.

What is claimed is:

1. A shield connector to be connected to a device-side connector provided on a device, comprising:

a resin housing having a fitting portion for connecting to the device-side connector and a tubular wire pull-out portion extending from the fitting portion, the wire pull-out portion having a wire pull-out hole with an opening edge facing away from the fitting portion defining a housing-side holding portion;

at least one terminal mounted in the housing and configured to be connected to at least one device-side terminal in the device-side connector;

at least one wire connected to the terminal and pulled out from the housing in a pull-out direction that extends parallel to the wire; and a resin molded body molded onto the wire to define a unitary matrix of resin held in close contact with an outer peripheral surface of the wire, the resin molded body having a molded fitting portion fit in the tubular wire pull-out portion of the housing and a molded main body cross-sectionally larger than the wire pull-out portion and disposed external of the wire pull-out portion, the resin molded main body having a first end surface adjacent the molded fitting portion and held in contact with the housing-side holding portion and a second end surface facing oppositely from the first end surface; and a shield shell covering the housing and the molded main body and being configured to be connected to a shield case of the device, a portion of the shield shell that covers the resin molded main body being formed with a shell-side holding portion protruding inward and contacting the second end surface of the molded main body of the resin molded body so that the resin molded main body is sandwiched in the pull-out direction of the wire between the housing-side holding portion of the resin housing and the shield shell and in direct contact with both the housing-side holding portion and the shell-side holding portion of the shield shell.

2. The shield connector of claim 1, comprising a housing-side seal ring mounted on an outer peripheral surface of the molded fitting portion of the resin molded body and held in close contact with an inner peripheral surface of the wire pull-out portion over an entire inner circumference of the wire pull-out portion.

3. The shield connector of claim 2, further comprising a shell-side seal ring mounted on the outer peripheral surface of the resin molded main body and held in close contact with the outer peripheral surface of the resin molded main body and an inner peripheral surface of the shield shell over an entire inner circumference of the shield shell.

4. The shield connector of claim 1, wherein the shield shell is fixed to the shield case of the device by a bolt tightened in a direction intersecting the pull-out direction of the wire.

5. The shield connector of claim 1, wherein the at least one terminal comprises a plurality of terminals and the at least one wire comprises a plurality of wires.

6. The shield connector of claim 5, wherein the resin molded body defines an integral or unitary matrix of resin surrounding the plurality of wires.

7. A shield connector, comprising:

a housing having a fitting portion and a tubular wire pull-out portion extending from the fitting portion, the wire pull-out portion having a wire pull-out hole with an opening edge defining a housing-side holding portion;

terminals mounted in the housing;

wires connected respectively to the terminals and pulled out from the housing in a pull-out direction that extends parallel to the wires; and a resin molded body molded onto the wires to define a unitary matrix of resin held in close contact with outer peripheral surfaces of the wires, the resin molded body having a molded fitting portion fit in the wire pull-out portion of the housing and a molded main body cross-sectionally larger than the wire pull-out portion and disposed external of the wire pull-out portion, the resin molded main body having a first end surface held adjacent to the molded fitting portion and in contact with the housing-side holding portion and a second end surface facing oppositely from the first end surface; and a shield shell covering the housing and the molded main body, a portion of the shield shell that covers the resin molded main body being formed with a shell-side holding portion protruding inward and contacting the second end surface of the molded main body of the resin molded body so that the resin molded body is sandwiched in the pull-out direction of the wire by the resin housing and the shield shell and in direct contact with both the housing-side holding portion and the shell-side holding portion.

8. The shield connector of claim 7, further comprising a housing-side seal ring mounted on an outer peripheral surface of the molded fitting portion of the resin molded body and held in close contact with an inner peripheral surface of the wire pull-out portion over an entire inner circumference of the wire pull-out portion.

9. The shield connector of claim 8, further comprising a shell-side seal ring mounted on the outer peripheral surface of the resin molded main body and held in close contact with the outer peripheral surface of the resin molded main body and an inner peripheral surface of the shield shell over an entire inner circumference of the shield shell.

* * * * *